US008814143B2

(12) United States Patent
Lawson et al.

(10) Patent No.: US 8,814,143 B2
(45) Date of Patent: Aug. 26, 2014

(54) INCLINED DRUM ARRANGEMENT FOR WINCH APPARATUS

(75) Inventors: Andrew Lawson, Hamilton (GB); Campbell McFall, Hamilton (GB); Dennis O'Hara, Hamilton (GB)

(73) Assignee: Parkburn Precision Handling Systems Limited (GB)

( * ) Notice: Subject to any disclaimer, the term of this patent is extended or adjusted under 35 U.S.C. 154(b) by 0 days.

(21) Appl. No.: 13/637,482

(22) PCT Filed: Mar. 17, 2011

(86) PCT No.: PCT/GB2011/000373

§ 371 (c)(1),
(2), (4) Date: Sep. 26, 2012

(87) PCT Pub. No.: WO2011/121272

PCT Pub. Date: Oct. 6, 2011

(65) Prior Publication Data

US 2013/0020544 A1 Jan. 24, 2013

(30) Foreign Application Priority Data

Mar. 27, 2010 (GB) ..... 1005200.9

(51) Int. Cl.
*B66D 1/14* (2006.01)

(52) U.S. Cl.
USPC ..... 254/294; 254/278; 254/288; 254/290; 254/293

(58) Field of Classification Search
USPC ..... 254/278, 288, 290, 293, 294, 393, 394, 254/395, 396, 371, 93
See application file for complete search history.

(56) References Cited

U.S. PATENT DOCUMENTS

| | | | | |
|---|---|---|---|---|
| 4,204,664 | A * | 5/1980 | Bryan, Jr. | 254/288 |
| 5,217,176 | A | 6/1993 | Hall | |
| 5,779,226 | A * | 7/1998 | Wudtke | 254/278 |
| 6,182,915 | B1 * | 2/2001 | Kvalsund et al. | 242/364.2 |
| 7,175,163 | B2 * | 2/2007 | Blanc | 254/278 |

FOREIGN PATENT DOCUMENTS

| | | |
|---|---|---|
| FR | 1105165 | 11/1955 |
| GB | 142016 | 2/1976 |
| GB | 2009077 A | 6/1979 |
| SU | 459423 A1 | 3/1975 |
| SU | 1306896 A1 | 9/1985 |
| WO | 0010903 A1 | 3/2000 |
| WO | 0053956 A1 | 9/2000 |

OTHER PUBLICATIONS

International Search Report; International Application No. PCT/GB2011/000373; International Application Filing Date Mar. 17, 2011; Mail Date Jun. 24, 2011.
Written Opinion International Application No. PCT/GB2011/000373; International Application Filing Date Mar. 17, 2011; Mail Date Jun. 24, 2011.

* cited by examiner

*Primary Examiner* — Emmanuel M Marcelo
*Assistant Examiner* — Angela Caligiuri
(74) *Attorney, Agent, or Firm* — Cantor Colburn LLP

(57) ABSTRACT

A winch apparatus (10) comprises first and second drum assemblies (12, 14) each defining a discontinuous drum contact surface for engaging a common spoolable medium (50), wherein the first and second drum assemblies (12, 14) are configured to rotate about respective first and second axes of rotation (24, 26) which are inclined relative to each other. In one disclosed embodiment the drum assemblies (12, 14) are intermeshed in a general axial direction.

41 Claims, 5 Drawing Sheets

INCLINED DRUM ARRANGEMENT FOR WINCH APPARATUS

FIELD OF THE INVENTION

The present invention relates to a winch apparatus, and in particular, but not exclusively, to a capstan style winch apparatus.

BACKGROUND TO THE INVENTION

Winches are used in many applications to move payloads via spoolable media, such as metal, synthetic or fibre cables, wires and ropes. Typically, a winch includes a drum or spool around which a spoolable medium is wound, wherein rotation of the drum permits spooling of the medium.

In some species of winch the drum also acts to store the spoolable medium, with the medium be arranged in single or multiple wraps and layers between end flanges of the drum. In such winch species, however, the spoolable medium may be subject to significant radial crushing forces, particularly in circumstances where large payloads are involved and thus significant tensions are applied to the spoolable medium. Further, in some applications it may be necessary to store the medium in a high tension state, which may reduce the life span of the medium through fatigue, excessive strains, hysteresis and the like. Furthermore, storage of the spoolable medium on a drum typically requires the use of complex fleeting arrangements to ensure that the medium is arranged in suitable wraps and layers.

In other species of winch the drum is used only to apply a force to a spoolable medium, with the spoolable medium being stored separately, for example in a basket, on a separate spool or the like. The force applied by the drum is typically either a pulling force to pay in a spoolable medium, or a controlled releasing force to permit controlled paying out of a spoolable medium while under load, for example while connected to a payload. In such winch species, which may include capstan or windlass winches, an intermediate portion of a spoolable medium is wrapped around the drum a number of times such that an outboard side of the spoolable medium extends from the drum to engage a payload, and an inboard side of the spoolable medium extends to storage. Under loaded conditions the drum functions to reduce the tension in the spoolable medium from a high tension condition in the outboard side, to a lower tension condition in the inboard side of the spoolable medium, thus permitting the spoolable medium to be stored in a favourable low tension state. In view of this tension reduction functionality, such winch species are often called detensioning units. In use, the drum establishes a tension gradient in the spoolable medium, which may be defined by the capstan friction equation:

$$\frac{T_1}{T_2} = e^{\mu\theta}$$

wherein:

$T_1$=outboard tension $T_2$=inboard tension $\mu$=co-efficient of friction between the spoolable medium and the drum or contact surface $\theta$=angle of contact with the drum (e.g., one wrap is $2\pi$ radians)

In existing winch devices the tension gradient may not be evenly distributed across the spoolable medium in contact with the drum, which may result in non-uniform tension reduction with possible adverse effects on the medium, such as variable strain distribution and the like.

In such capstan style winch species, arrangements are typically made to ensure that the spoolable medium follows a defined path around the drum to ensure appropriate separation between adjacent wraps, provide appropriate take off points for both outboard and inboard sides, prevent piling or bunching at flanged ends of the drum, and the like. These arrangements may include the use of grooves or flutings on the surface of the drum, the use of knives or fleeting rings and the like. GB 2 009 077, GB 1 425 016 and WO 00/10903 each discloses arrangements in which drum grooves are utilised.

However, such arrangements for suitably handling a spoolable medium along a desired path may involve complex mechanisms, which may be expensive and subject to failure. Further, existing arrangements may not adequately handle features of a spoolable medium, such as splices, connectors, sockets and the like. Also, existing arrangements, such as knives or fleeting rings, may result in adverse twisting of the spoolable medium, and can increase the frictional forces applied to the medium, which may result in abrasion or other damage which may affect mechanical integrity.

SUMMARY OF THE INVENTION

According to a first aspect of the present invention there is provided a winch apparatus comprising first and second drum assemblies each defining a discontinuous drum contact surface for engaging a common spoolable medium, wherein the first and second drum assemblies are configured to rotate about respective first and second axes of rotation which are inclined relative to each other.

The winch apparatus may be configured to function as a detensioning device for use in reducing tension within a spoolable medium. The winch apparatus may be configured as a capstan winch apparatus.

The first and second axes of rotation may be inclined relative to each other in a single reference plane. The first and second axes may be inclined relative to each other in two reference planes, such as two mutually perpendicular reference planes. The first and second axes of rotation may be inclined axially and/or radially relative to each other. The first and second axes of rotation may be inclined relative to each other so as to be in non-parallel relation. For example, the first and second axes of rotation may be inclined to intersect each other at an intersection angle. The first and second axes of rotation may be arranged eccentrically relative to each other. In some embodiments the first and second axes of rotation may be laterally offset from each other.

Each drum contact surface may be aligned generally parallel to an associated drum axis of rotation. In this arrangement the drum contact surfaces of the respective first and second drum assemblies may also be inclined relative to each other to the same extent as the first and second axes of rotation.

In use, the first and second drum assemblies may be configured to permit a common spoolable medium to be wrapped around the respective drum contact surfaces, such that rotation of each drum assembly may apply a force to the spoolable medium. The winch apparatus may therefore be used to pay in the spoolable medium to, for example apply a pulling force on an attached payload, and/or to permit controlled paying out of the spoolable medium, for example to deploy an attached payload.

The first and second drum assemblies may be configured to engage a wrapped intermediate portion of a spoolable medium, such that end portions of the spoolable medium on either side of the intermediate wrapped portion may extend outwardly from the winch apparatus. One end portion may be defined as an outboard end portion, and the other end portion may be defined as an inboard end portion. This arrangement may permit the winch apparatus to function as a capstan type winch. For example, rotation of the first and second drum assemblies may apply a tension gradient along the length of the spoolable medium in contact with the winch apparatus. This tension gradient may be determined in accordance with the capstan friction equation:

$$\frac{T_1}{T_2} = e^{\mu\theta}$$

wherein:

$T_1$=outboard tension $T_2$=inboard tension $\mu$=co-efficient of friction between the spoolable medium and the drum $\theta$=angle of contact with the drum (e.g., one wrap is $2\pi$ radians)

Thus, the tension gradient may be determined as a function of the wrap contact angle and co-efficient of friction between the spoolable medium and the contact surfaces. In normal use, one end portion of the spoolable medium may be at a higher tension than the other end portion. One end portion, such as a high tension portion (which may be an outboard end portion), may extend to engage a payload, and the other end portion, such as a low tension portion (which may be an inboard end portion), may be suitably stored, for example on a spool, in a basket or the like.

In one embodiment the winch apparatus may be provided in combination with, or comprise, a tensioner arrangement, which may function to apply a degree of tension to at least one end portion of a spoolable medium. For example, a tensioner arrangement may be configured to apply tension to a low tension portion (for example an inboard end portion) of a spoolable medium which extends from the winch apparatus. The tensioner arrangement may be configured to permit greater control over the achievable tension in a high tension portion of the same spoolable medium. For example, a tensioner device may be utilised to increase tension in a low tension end portion, such that a tension gradient applied by the winch apparatus may accommodate a higher tension in a high tension end portion (in accordance with the capstan friction equation defined above). The tensioner device may comprise a further winch, such as a drum winch, traction winch, winch apparatus according to the present invention or the like. The tensioner device may comprise a track tensioner. In some situations, such as static situations a tensioner device may be configured not to apply any tension. In other situations, such as in dynamic situations, a tensioner device may be configured to apply a degree of tension.

The relative inclined alignment of the first and second axes of rotation of the drum assemblies may permit the respective drum contact surfaces to cooperate to manipulate an associated spoolable medium to follow a predefined path, such as a predefined helical path. This predefined path may advantageously permit adjacent wraps of a spoolable medium to be preferentially aligned during rotation of the drum assemblies, for example to be arranged and retained in non-contact relationship with each other, with a preferred separation gap or the like. Furthermore, the relative inclined alignment of the axes of rotation may permit a spoolable medium to exit or enter the winch assembly at a desired and/or constant location. This preferred control over the path of an associated spoolable medium may eliminate the requirement to provide additional control equipment, such as knives, fleeting arrangements, flutings or the like, and thus avoid the disadvantages of such arrangements, for example disadvantages associated with costs, complexity, maintenance, increased weight and the like.

The angle of relative inclination of the first and second axes of rotation may be fixed. Alternatively, the angle of relative inclination may be adjustable.

The angle of relative inclination of the first and second axes of rotation may be selected to influence or provide a predetermined path, such as a predetermined helical path of a spoolable medium, for example the number of wraps, spacing between individual wraps or the like. The angle of relative inclination of the axes may be selected in accordance with the type of spoolable medium, which may include a metal or synthetic or fibre wire, cable, rope or the like.

In some arrangements the angle of relative inclination of the axes of rotation may define a pitch angle of one or more wraps of a spoolable medium.

The angle of relative inclination of the first and second axes of rotation may be selected to be in the region of, for example, 0.1 to 20 degrees, such as between 0.5 and 10 degrees. In some embodiments the angle of relative inclination may be selected to be in the region of 1 to 3 degrees. In one embodiment the relative angle of inclination may be selected to be in the region of 1.8 degrees.

The drum assemblies may be arranged such that, in use, a spoolable medium engages the drum contact surface of both the first and second drum assemblies. The drum assemblies may be arranged such that, in use, a spoolable medium engages a portion of the drum contact surface of both the first and second drum assemblies. In one embodiment the drum assemblies may be arranged such that, in use, for each single wrap of a spoolable medium, one portion, such as a half portion, of the spoolable medium wrap engages the drum contact surface of the first drum assembly, and the remaining portion, such as the other half portion, engages the drum contact surface of the second drum assembly. This arrangement, in combination with the relative inclination of the first and second axes of rotation, may permit a predefined path of the spoolable medium to be achieved. This arrangement may also permit the loading on the winch apparatus to be split between the first and second drum assemblies, and any associated supporting arrangements.

The discontinuous drum contact surfaces (which may be provided by separate support elements as defined below) may permit a discretised tension gradient to be applied across the length of a spoolable medium in contact with said surfaces. For example, the discontinuous drum contact surfaces will provide intermittent contact with a spoolable medium, such that discrete portions of a complete tension gradient across the complete length of the spoolable medium will be achieved at those individual discrete locations of contact. This arrangement may permit more control over the tension gradient in the spoolable medium. Furthermore, this arrangement may permit a required tension gradient to be ensured over a minimum length of a spoolable medium. Accordingly, high resolution de-tensioning may be achieved by applying many small points of contact providing a proportionally small variance in tension differential. Thus, changes in length, relative movement, work and the like are minimised to mitigate frictional heat generated in the spoolable medium. Tension may therefore be removed or added in many small accurately controlled linear steps as opposed to a low quantity of large steps as present in prior art systems. This arrangement provides a kind method of working the spoolable medium to provide longer life and operate the spoolable medium in its natural form without applying excessive external forces.

The discontinuous contact surface may facilitate cooling of the spoolable medium when in use, for example by permitting increased flow of a coolant, such as air, around the spoolable medium, for example between individual support elements. Additionally, the discontinuous contact surface may facilitate drainage, for example where the spoolable medium is retrieved from a liquid environment, such as a sea environment. For example, in embodiments where a discontinuous surface is provided by multiple spaced apart support elements, drainage may be permitted through the gaps between adjacent support elements.

Each drum assembly may comprise a plurality of support elements configured to collectively define the respective drum contact surfaces. The support elements may be elongate. The support elements may be arranged parallel with the respective axes of rotation. The support elements may be circumferentially arranged about a respective axis of rotation of the drum assemblies. Each support element may comprise an individual support surface arranged to define a discrete portion of a respective drum contact surface. The individual support surface of one or more support elements may define an arc shape. In one arrangement the individual support surface of one or more support elements may define a circular arc shape. The individual support surface of one or more support elements may extend for a defined arc angle, wherein the arc angle is defined by the central angle formed by the end points of the arc. Each support element may define an arc shape support surface, wherein the combined arc angle of the support elements of a single drum assembly may extend 360 degrees. This arrangement may permit a preferential support of a spoolable medium over the collective drum contact surfaces, which may prevent any kinking or the like of the spoolable medium across any edge regions of the support elements. This arrangement may also permit a preferential support of a spoolable medium to be permitted while achieving a maximum tension gradient within the spoolable medium by maximising the available wrap angle.

A pair of adjacent support elements may define respective arc shaped surfaces, wherein facing edges of the adjacent arc shaped surfaces are arranged tangentially to each other. This arrangement may permit a spoolable medium to extend tangentially between adjacent support elements, thus achieving complete contact with each individual surface and preventing any adverse kinking or the like of the spoolable medium as it leaves one support surface and arrives at the other support surface.

The support elements may be arranged relative to each other to create a discontinuous drum contact surface. Adjacent support elements may be spaced from each other to define a gap therebetween. This arrangement may provide the respective discontinuous drum contact surfaces. Providing support elements with gaps therebetween may permit the support elements to be positioned to define a desired effective drum diameter, for example which is appropriate to the particular spoolable medium, and at the same time provide the necessary overall wrap angle to achieve a suitable tension gradient while minimising the actual contact surface area. That is, the support elements may be arranged within an individual drum assembly to provide an effective drum diameter, with an overall reduced contact surface.

The provision of gaps between support elements may provide advantages in terms of cooling, drainage and the like, as identified above.

The support elements may be rigidly mounted within the respective drum assemblies. Such rigid mounting may provide a fixed effective drum diameter. Alternatively, the support elements may be adjustably mounted within a respective drum assembly, which may permit an effective drum diameter to be adjusted. This may permit use of the winch apparatus with different spoolable media. This arrangement may also permit the support elements to be adjusted for compensation requirements, for example to compensate for any movement of the entire winch apparatus relative to a datum point. This may have benefit in offshore applications, where the winch apparatus may be used to deploy or retrieve payloads into or from the sea.

The support elements may be formed separately and subsequently mounted within the respective drum assemblies, for example by use of mechanical fasteners, welding or the like. Alternatively, the support elements may be provided as integral components of the respective drum assemblies. For example, the support elements may be integrally cast with the respective drum assemblies.

Each drum assembly may comprise a flange member configured to support a plurality of support elements, for example at respective end regions of the support elements, or respective intermediate portions of the support elements. Each drum assembly may comprise two flange members configured to support opposite end regions of each associated support element. This arrangement may define a cage structure, such as a generally cylindrical cage structure.

The drum assemblies may be arranged to overlap in an axial direction. This may permit a spoolable medium to extend across, for example generally laterally or transversely of, both axes of rotation to engage the respective drum contact surfaces without requiring any imposed direction change to move from one surface to the other.

The drum assemblies may be arranged to overlap in a radial direction. The drum assemblies may be configured to be intermeshed relative to each other. In one embodiment each drum assembly may comprise a plurality of support elements arranged to define gaps therebetween, wherein the support elements of one drum assembly are configured to be positioned in the gaps between the support elements on the other drum assembly, and vice versa. Accordingly, the support elements of each drum assembly may intermesh or interleave each other. This arrangement may permit the advantages of the present invention, for example in relation to providing a predefined path for a spoolable medium, to be achieved while presenting a minimal footprint.

The drum assemblies may be arranged on separate support arrangements, such as separate support shafts. The separate support shafts may be appropriately arranged to provide the relative inclination between the first and second axes of rotation.

The drum assemblies may be arranged on a common support arrangement, such as a common support shaft. For example each drum assembly may be arranged to be rotatable about a common support shaft. In this arrangement one or both of the drum assemblies may be offset relative to the support shaft to provide the relative inclination between the first and second axes of rotation. For example, one or both of the drum assemblies may be arranged on an offset portion of the support shaft, mounted on an offset bearing arrangement or the like.

The drum assemblies may be arranged to be offset from each other in a radial direction, for example side by side. In this arrangement the drum assemblies may be provided in non-intermeshing relation. This arrangement may permit smaller drum assemblies to be utilised.

The winch apparatus may comprise a drive arrangement configured to drivingly rotate both drum assemblies. The drive arrangement may be configured to synchronously drive both drum assemblies. This arrangement may assist to ensure that the contact between the respective drum contact surfaces and a spoolable medium is optimised. Additionally, this may prevent slippage of the spoolable medium relative to one or both the drum contact surfaces. Also, this arrangement may minimise any axial rotation of the spoolable medium.

The drive arrangement may comprise a single drive assembly configured to drive both drum assemblies, for example via a mechanical transmission arrangement, such as a belt drive, chain drive, gear train or the like. Alternatively, the drive arrangement may comprise a first drive apparatus associated with the first drum assembly, and a second drive apparatus associated with the second drum assembly. In this embodiment the drive arrangement may comprise a controller configured to permit common control of the first and second drive apparatus.

The drive arrangement may function to provide braking to one or both drums.

The apparatus may comprise a braking arrangement configured to provide braking to one or both drums. The braking arrangement may comprise an electrical braking arrangement friction braking arrangement of the like.

The surface of one or both of the drum contact surfaces may be configured such that the coefficient of friction between the respective surfaces and a spoolable medium is less than the coefficient of friction between individual components of the spoolable medium, such as braids, strands or the like. This may assist in achieving a desired low tension gradient in the spoolable medium. One or both of the drum contact surfaces may comprise a coating, such as a chrome coating, ceramic coating or the like.

The winch apparatus may be configured for use with, or may comprise, a spoolable medium storage arrangement. The storage arrangement may comprise a spool, basket or the like.

The winch apparatus may itself be compensated and/or may be configured for use with, or may comprise, a compensator arrangement. The compensator arrangement may comprise a heave compensator arrangement, for example to compensate for heaving motion of an offshore vessel upon which the winch apparatus is located.

The winch apparatus may be configured for use with different types of spoolable media. For example, the winch assembly may be configured for use with a synthetic or fibre spoolable media. The winch apparatus may be configured for use with BOB (Braid Optimised for Bending), Plasma, Spectra, Dynema or similar like rope structures.

The winch apparatus may be configured for use in multiple applications. In some arrangements the winch apparatus may be configured for use in onshore applications, for example as part of a crane assembly. In some arrangements the winch apparatus may be configured for use in offshore applications, for example for use in deploying and recovering payloads into and from the sea, as part of a crane assembly or the like.

According to a second aspect of the present invention there is provided a method of establishing a tension gradient within a spoolable medium, comprising:

providing first and second drum assemblies each defining a discontinuous drum contact surface;

wrapping a portion of the spoolable medium around the contact surface of both the first and second drum assemblies; and rotating both the first and second drum assemblies about respective first and second axes of rotation which are inclined relative to each other.

The method according to the second aspect may relate to a method of operating the winch apparatus according to the first aspect. Accordingly, optional features associated with the second aspect may be assumed to include any feature, taken in isolation or combination, identified in relation to the first aspect. For example, the method may comprise arranging the drum assemblies to intermesh each other, to be side by side or the like.

According to a third aspect of the present invention there is provided a winch system comprising a winch apparatus according to the first aspect.

The winch system may comprise a spoolable medium storage arrangement. The storage arrangement may comprise a spool, basket or the like. The winch system may comprise a compensator arrangement. The compensator arrangement may comprise a heave compensator arrangement, for example to compensate for heaving motion of an offshore vessel upon which the winch assembly is located.

Other aspects of the invention may relate to a crane arrangement which comprises a winch apparatus according to the first aspect.

Other aspects may relate to a vessel, such as an offshore or onshore vessel, which comprises a winch apparatus according to the first aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
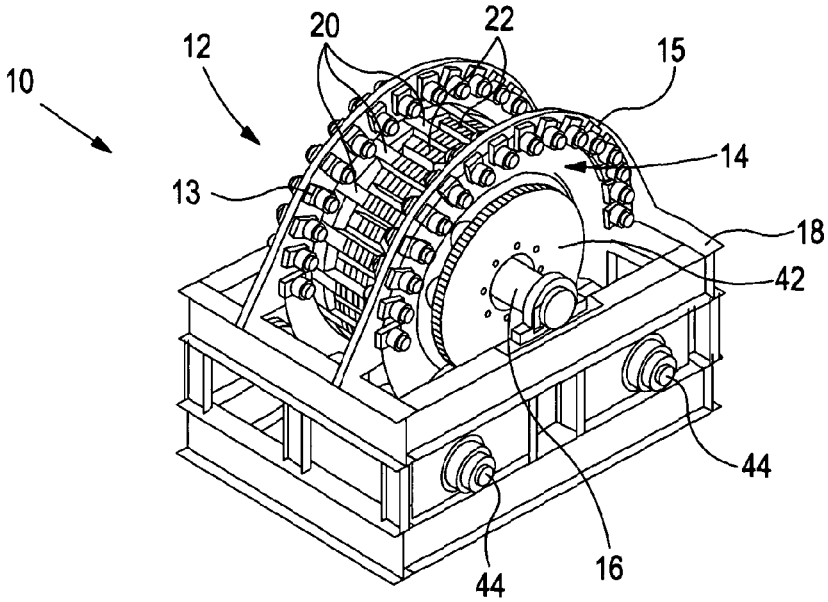
FIG. 1 is a perspective view of a winch apparatus according to an embodiment of the present invention.

A perspective view of a winch apparatus, generally identified by reference numeral 10, in accordance with an embodiment of the present invention is shown in FIG. 1. As will be discussed in further detail below, the winch apparatus 10 is configured as a capstan type winch for use in operation with a spoolable medium, such as a metal or synthetic wire, rope, cable or the like.

The winch apparatus 10 comprises first and second drum assemblies 12, 14 mounted on a common support shaft 16 which is secured to a frame 18. The first drum assembly 12 comprises a plurality of circumferentially arranged support elements 20 each having discrete contact surfaces which collectively define a drum contact surface of the first drum assembly 12. The support elements 20 are arranged with gaps defined therebetween, such that a discontinuous drum support surface is established. Similarly, the second drum assembly 14 also comprises a plurality of circumferentially arranged support elements 22 having individual discrete contact surfaces which collectively define a drum contact surface of the second drum assembly 14. The support elements 22 are also arranged with gaps therebetween, such that a discontinuous drum contact surface is established. As illustrated, the drum assemblies 12, 14 are arranged such that the respective support elements 20, 22 are intermeshed. That is, the support elements 20 of the first drum assembly 12 are arranged in the gaps defined between the support elements 22 of the second drum assembly 14, and vice versa. Accordingly, the first and second drum assemblies 12, 14 may be arranged to overlap in both axial and radial directions.

Figure 2:
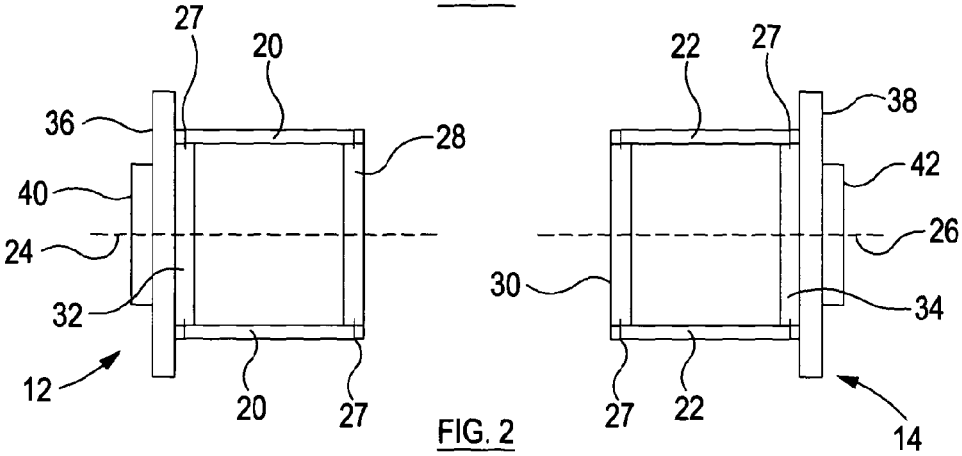
FIG. 2 is a simplified illustration of two separate drum assemblies of the winch apparatus of FIG. 1, wherein the drum assemblies are shown separated.

Reference is additionally made to FIG. 2, which provides a simplified and diagrammatic illustration of the first and second drum assemblies 12, 14, shown separated for clarity. Each drum assembly 12, 14 is provided generally in the form of a cylindrical cage, with the respective support elements 20, 22 arranged circumferentially around respective first and second axes of rotation 24, 26. Each support element 20, 22 is arranged parallel with a respective axis of rotation 24, 26 such that the defined discontinuous drum contact surface of each drum assembly 12, 14 is also arranged parallel with a respective rotation axis 24, 26. Each support element 22, 24 is generally elongate with opposite ends of each support element 22, 24 secured via mechanical fasteners 27 to the outer periphery of respective inner support members 28, 30 and respective outer support members 32, 34. The outer members 28, 30 are mounted on respective winch flanges 36, 38. Further, each drum assembly 12, 14 comprises a slewing gear ring 40, 42 configured to be engaged by a drive arrangement comprising multiple individual drive assemblies 44 (see FIG. 1). In other embodiment a single drive assembly may be provided. The drive arrangement is configured to rotate each drum assembly 12, 14 about the respective rotation axes 24, 26 in a synchronous manner. The drive arrangement may be electric, hydraulic, pneumatic, engine or the like, or any suitable combination thereof.

Figure 3:
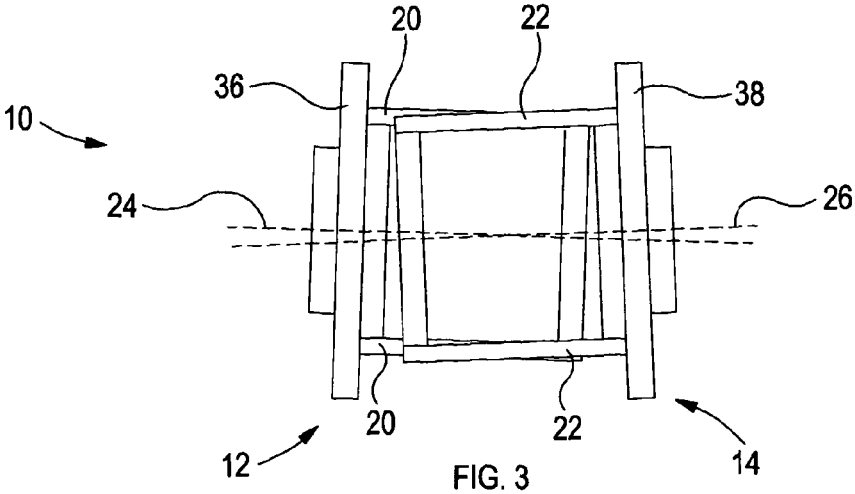
FIG. 3 is a further simplified illustration of the two separate drum assemblies of FIG. 6, wherein the drum assemblies are shown in an intermeshed configuration.

FIG. 3 shows the simplified drum assemblies 12, 14 of FIG. 2 intermeshed to define the complete winch apparatus 10. As illustrated, the drum assemblies 12, 14 are arranged such that the first and second axes of rotation 24, 26 are inclined relative to each other, which results in the discontinuous contact surfaces of each drum assembly 12, 14 also being inclined relative to each other. It should be understood that the angle of inclination has been exaggerated for purposes of the present description. As will be discussed in further detail below, this inclined arrangement of the first and second drum assemblies 12, 14 establishes a preferential path of an associated spoolable medium wrapped around the winch apparatus 10. A more detailed description of the relative inclination of the first and second axes of rotation will now be given with reference to FIGS. 4 and 5.

Figure 4A:
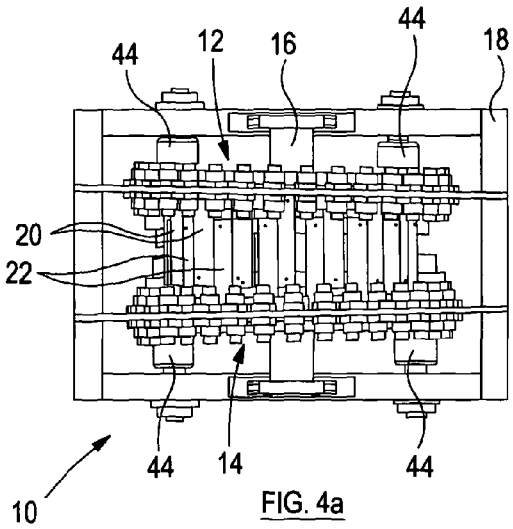
FIG. 4*a* is a view of the winch apparatus of FIG. 1 from above.
Figure 4B:
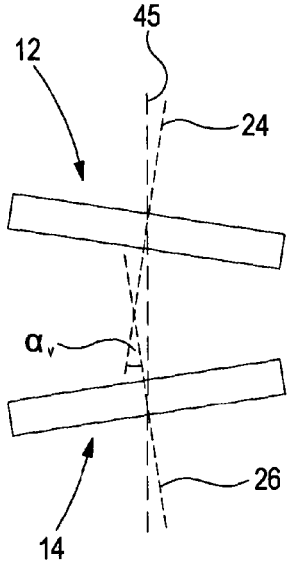
FIG. 4*b* is a diagrammatic representation demonstrating a relative inclination between two axes of rotation of the winch apparatus in a vertical plane.

Reference is first made to FIG. 4, wherein FIG. 4*a* shows the winch apparatus 10 from above, and FIG. 4*b* provides a simplified illustration of the relative inclination which demonstrates a relative inclination between the axes of rotation 24, 26, with the relative inclination exaggerated for clarity. As illustrated, the drum assemblies 12, 14 are transversely skewed relative to a vertical plane 45 such that the first and second rotation axes 24, 26 define a relative inclination angle $\alpha_v$. In the present exemplary embodiment inclination angle $\alpha_v$ may be in a region between 1 to 3 degrees, for example around 1.8 degrees. The individual drive assemblies 44 are also clearly illustrated in FIG. 4*a*, wherein each drum 14, 16 is engaged to be drive by two of the drive assemblies 44. Further, each drive assembly 44 is mounted on the frame 18 in a manner to accommodate the relative inclination of each drum assembly 12, 14.

Figure 5A:
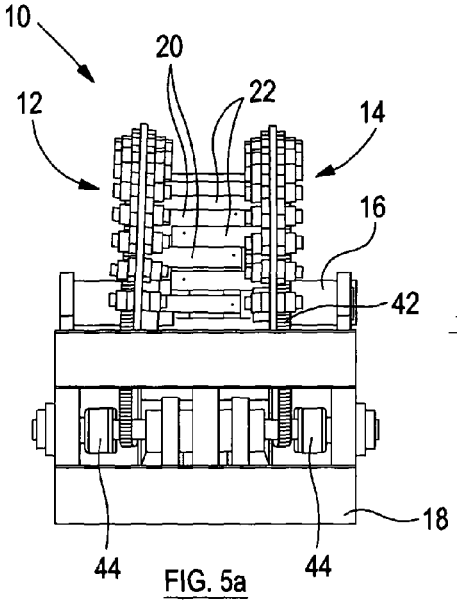
FIG. 5*a* is a view of the winch apparatus of FIG. 1 from the front.
Figure 5B:
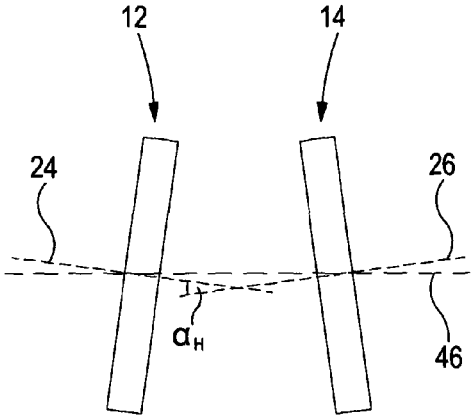
FIG. 5*b* is a diagrammatic representation of a relative inclination between two axes of rotation of the winch apparatus in a horizontal plane.

FIG. 5*a* shows the winch apparatus 10 from the front, and FIG. 5*b* provides a simplified illustration of the relative inclination which demonstrates a relative inclination between the axes of rotation 24, 26, with the relative inclination exaggerated for clarity. As illustrated, the drum assemblies 12, 14 are also transversely skewed relative to a horizontal plane 46 such that the first and second rotation axes 24, 26 define an relative inclination angle $\alpha_H$. In the present exemplary embodiment inclination angle $\alpha_H$ may be in a region between 1 to 3 degrees, for example around 1.8 degrees.

It should be noted that both the first and second drum assemblies 12, 14 are rotatably mounted on the common support shaft 16. In this respect the support shaft may include offset portions configured to permit rotation of each drum assembly 12, 14 about the first and second inclined rotation axes.

Figure 6:
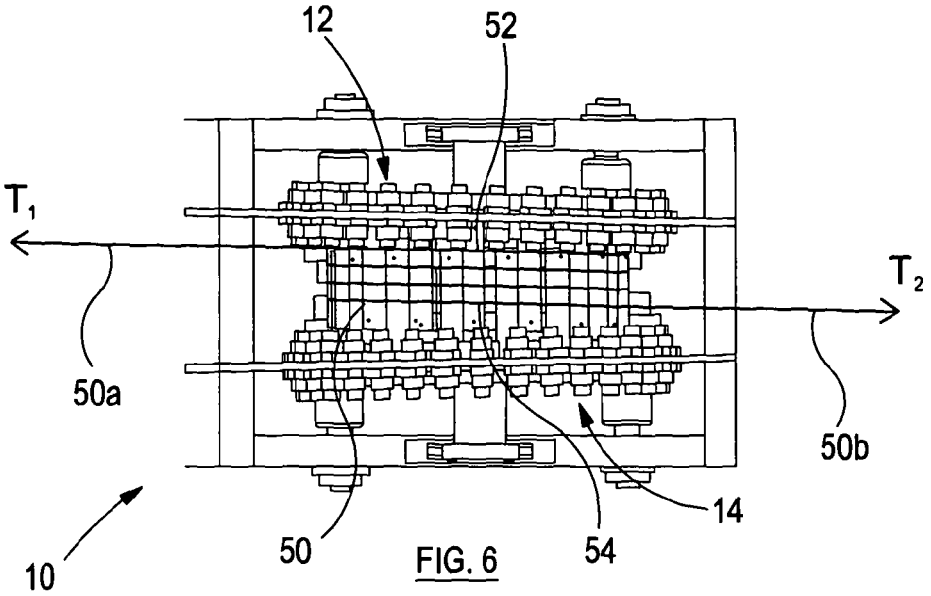
FIG. 6 is a view of the winch apparatus of FIG. 1 from above, showing an engaged spoolable medium.

Reference is now made to FIG. 6 of the drawings in which the winch apparatus 10 is shown from above and in use with a spoolable medium 50, such as a synthetic or fibre rope, such as a BOB (Braid Optimised for Bending) rope. As shown, the spoolable medium 50 is wrapped a number of times around each drum assembly 12, 14 with an outboard end 50*a* extending from one side of the winch assembly 10, specifically from a defined outboard take-off point 52, and an inboard end 50*b* extending from the opposite side of the winch assembly 10, specifically from a defined inboard take-off point 54. The outboard end 50*a* of the spoolable medium 50 may extend to engage a payload, and the inboard end 50*b* may extend to a storage location.

The spoolable medium 50 follows a defined helical path around each drum assembly 12, 14 between the defined take-off points 52, 54. The defined helical path and take-off points 52, 54 of the spoolable medium are established and fixed by the relative inclination of each drum assembly 12, 14. Accordingly, the requirement for any specific fleeting arrangements, such as knives or the like, is eliminated.

In use, the winch apparatus 10 is configured to apply a tension gradient along the portion of the spoolable medium 50 in contact with the contact surfaces of the drum assemblies 12, 14. Specifically, the apparatus 10 creates a tension gradient which reduces the tension in the spoolable medium from a high tension T1 in the outboard end 50*a* to a low tension T2 in the inboard end 50*b*. This tension gradient may be defined in accordance with the capstan friction equation defined hereinbefore, and noted again for convenience:

$$\frac{T_1}{T_2} = e^{\mu\theta}$$

wherein:

$T_1$=outboard tension $T_2$=inboard tension

μ=co-efficient of friction between the spoolable medium and the drum

θ=angle of contact with the drum (e.g., one wrap is 2π radians)

This tension gradient may be used to permit appropriate manipulation of a payload attached to the spoolable medium 50.

It should be noted that the relative inclination of the drum assemblies 12, 14 is such that for a single wrap of the spoolable medium 50, half of the spoolable medium is engaged only by the support elements 20 of the first drum assembly 12, and the other half of the spoolable medium is engaged only by the support elements 22 of the second drum assembly 14.

Figure 7:
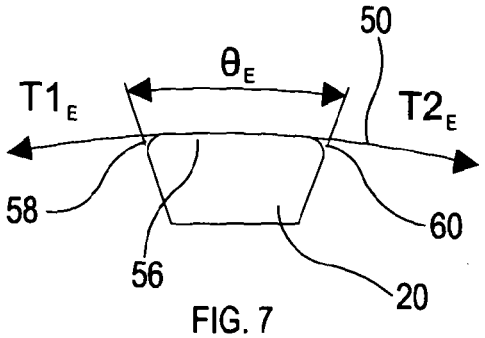
FIG. 7 is a diagrammatic representation of the individual tension gradient applied by each element.

As noted above, each drum assembly 12, 14 comprises a discontinuous contact surface provided by the spaced apart respective support elements 20, 22. Accordingly, each support element provides a discrete contribution to the total tension gradient applied across the spoolable medium, as will be described with reference to FIG. 7 which shows a cross-sectional view of a single support element 20. The support element 20 includes a curved surface 56 defined by a circular arc which extends for an arc angle .theta.sub.E defined by the central angle formed by the end points 58, 60 of the arc surface 56. It should be noted that the drum contact surface wrap angle defined by the support elements in each drum assembly 12, 14 totals 360 degrees. This arrangement may permit a preferential support of the spoolable medium 50 over the collective drum contact surfaces, which may prevent any kinking or the like of the spoolable medium 50 across any edge regions of the support elements 20, 22. This arrangement may also permit a preferential support of the spoolable medium 50 to be permitted while achieving a maximum tension gradient within the spoolable medium 50 by maximising the available wrap angle.

A spoolable medium 50 in contact with the curved surface 56 will have a high tension outboard end $T1_E$ and a lower tension inboard side $T2_E$, with the tension gradient being determined by:

$$\frac{T1_E}{T2_E} = e^{\mu\theta_E}$$

Accordingly, the total tension gradient may be a function of the total contact wrap angle θ (as set out in the capstan friction equation above), wherein the total contact wrap angle θ is provided by the sum of the individual arc angles $\theta_E$ of the support elements 20, 22. That is:

$$\theta=\Sigma\theta_E$$

The provision of the total tension gradient in individual discrete portions over the separate support elements 20, 22 may permit more control over the tension gradient in the spoolable medium 50. Furthermore, this arrangement may permit a required tension gradient to be ensured over a minimum length of the spoolable medium 50. Accordingly, high resolution de-tensioning may be achieved by applying many small points of contact providing a proportionally small variance in tension differential. Thus, changes in length, relative movement, work and the like are minimised to mitigate frictional heat generated in the spoolable medium 50. Tension may therefore be removed or added in many small accurately controlled linear steps as opposed to a low quantity of large steps as present in prior art systems. This arrangement provides a kind method of working the spoolable medium 50 to provide longer life and operate the spoolable medium 50 in its natural form without applying excessive external forces.

Figure 8:
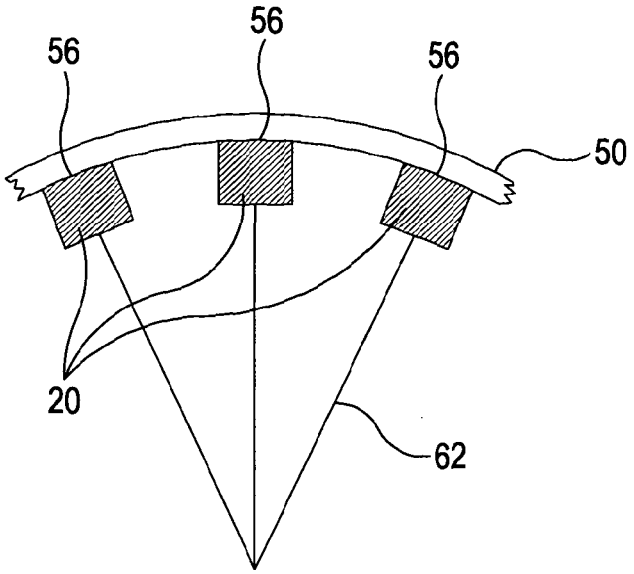
FIG. 8 is a diagrammatic representation of the interaction between individual support elements and a spoolable medium.

Reference is now made to FIG. 8 which shows a number of adjacent support elements 20 in cross-section, engaged with the spoolable medium 50. In this embodiment the facing edges of the arc shaped surfaces of adjacent elements 20 are arranged tangentially to each other. This arrangement permits the spoolable medium to extend tangentially between adjacent support elements 20, thus achieving complete contact with each individual surface 56 and preventing any adverse kinking or the like of the spoolable medium as it leaves one support element and arrives at an adjacent support element.

FIG. 8 also clearly illustrates the gap arrangement between adjacent support elements 20. This gap arrangement provides the respective discontinuous drum contact surfaces. Also, providing the support elements with gaps therebetween permits the support elements to be positioned to define a desired effective drum radius 62, for example which is appropriate to the particular spoolable medium 50, and at the same time provide the necessary overall wrap angle to achieve a suitable tension gradient while minimising the actual contact surface area. Furthermore, the provision of gaps between support elements may provide advantages in terms of cooling, drainage and the like.

Referring again to FIG. 1, each drum assembly 12, 14 comprises an associated braking arrangement 13, 15 configured to providing friction braking to the drum assemblies 12, 14. However, in alternative embodiments, the drive assemblies 44 may alternatively, or additionally, be configured to provide braking.

A winch apparatus in accordance with a second embodiment of the present invention will now be described with reference to FIGS. 9, 10 and 11. The winch apparatus, generally identified by reference numeral 110, is similar to the apparatus 10 first shown in FIG. 1 and as such like features share like reference numerals, incremented by 100.

Figure 9:
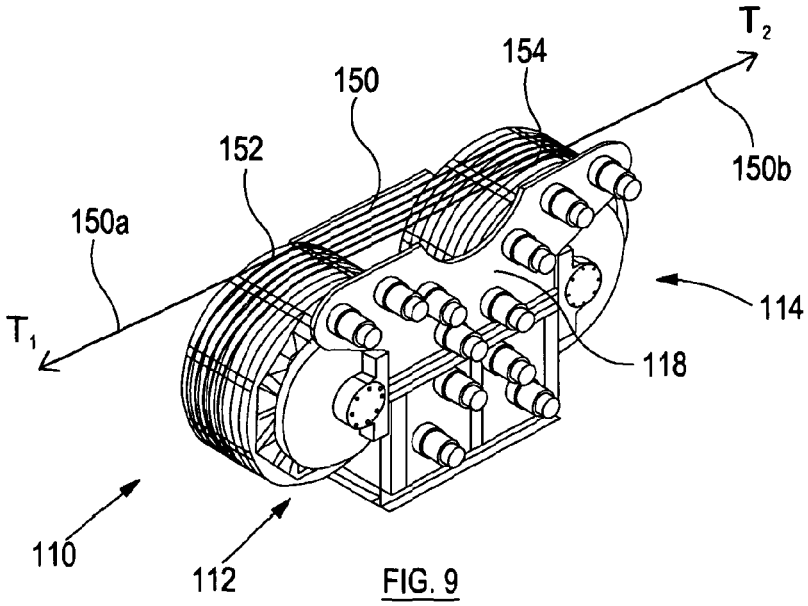
FIG. 9 is a perspective view of a winch apparatus in accordance with an alternative embodiment of the present invention.

Referring initially to FIG. 9, the apparatus 110 comprise a first and second drum assemblies 112, 114 which are mounted on a frame 118 and arranged to be separated in a radial direction, and to overlap in an axial direction. Each drum assembly 112, 114 is arranged to be engaged by a spoolable medium 150 to establish an outboard end 150*a* at a high tension T1, and an inboard end 150*b* at a lower tension T2.

Figure 10:
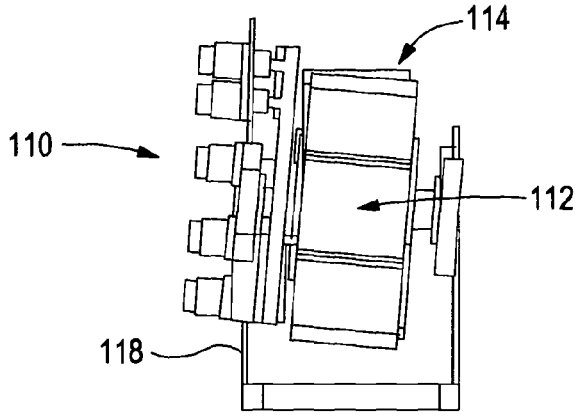
FIG. 10 is a front view of the winch apparatus of FIG. 9.
Figure 11:
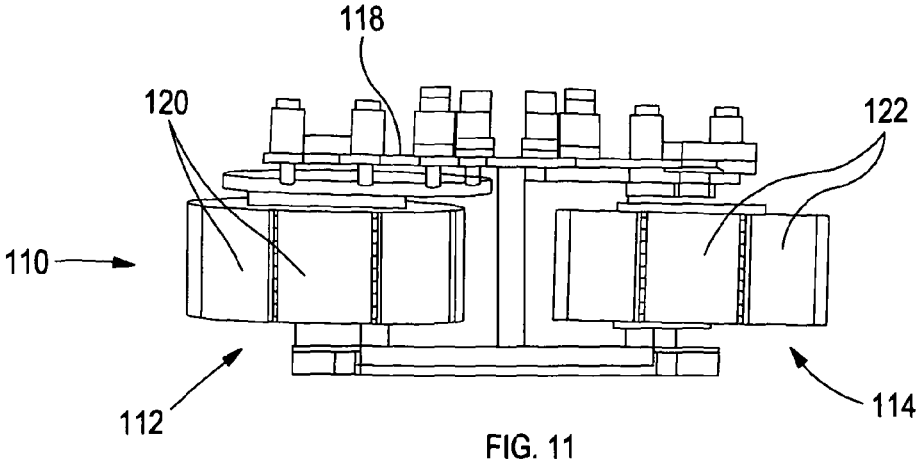
FIG. 11 is a top view of the winch apparatus of FIG. 9.

As shown in FIGS. 10 and 11, the first and second drum assemblies 112, 114 are mounted on the frame 118 to be inclined relative to each other. This relative inclination arrangement permits the spoolable medium 150 to follow a set and predefined helical path around each drum assembly 112, 114, and also to set the respective outboard and inboard take-off points 152, 154.

Referring particularly to FIG. 11, each drum assembly 112, 114 comprises a respective set of circumferentially arranged support elements 120, 122 which define gaps therebetween, wherein the support elements 120, 122 collectively define discontinuous drum contact surfaces of each drum assembly 112, 114.

The exemplary embodiments described herein may be used in a number of applications and environments. For example, the apparatuses 10, 110 may be used in onshore applications, for example in crane arrangements or the like. Further, the apparatuses 10, 110 may be used in marine environments, for example in offshore vessels, such as ships, oil rigs or the like. For example, the apparatuses 10, 110 may be used in applications for deploying and retrieving payloads to and from the sea.

The exemplary embodiments may also be used in combination with further equipment suited for the appropriate use. An example of such a combination of equipment is shown in FIG. 12, reference to which is now made.

Figure 12:
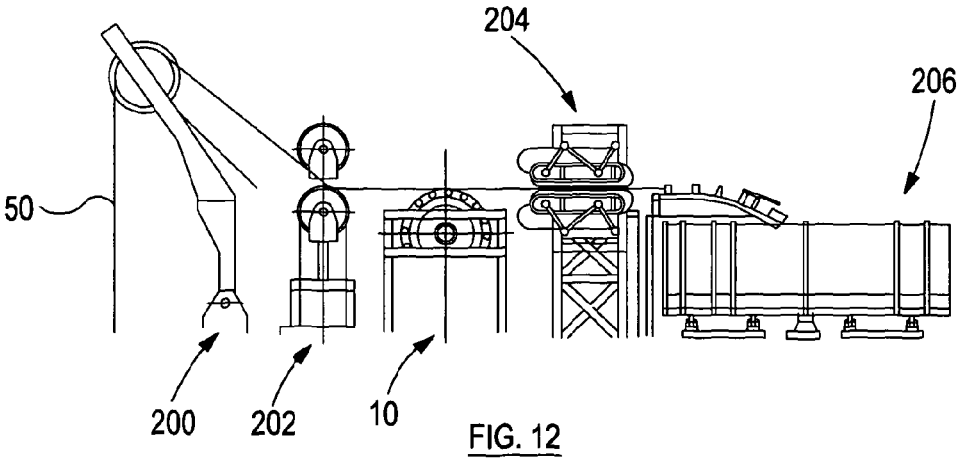
FIG. 12 is representation of a winch system which incorporates the winch apparatus of FIG. 1.

The exemplary arrangement of FIG. 12 reflects an offshore application and includes the winch apparatus 10 first shown in FIG. 1. In addition to the winch apparatus 10, the arrangement includes an overboarding assembly 200 which is used to appropriately direct a spoolable medium 50 (shown in broken outline) from a vessel (not shown) into the sea. Additionally, a heave compensator 202 is provided which provides dynamic compensation to the spoolable medium 50 to accommodate for heaving motion of the associated vessel. Further, the arrangement of FIG. 12 includes a track tensioner arrangement 204 which is configured to apply a degree of tension to an inboard side of the spoolable medium which extends from the winch apparatus 10. The track tensioner 204 may be used to apply a desired inboard tension in the spoolable medium 50 which permits an appropriate outboard tension to be accommodated, for example. The arrangement shown in FIG. 12 further includes a storage arrangement in the form of a storage basket 206 which permits the spoolable medium to be stored in a zero tension state.

Figure 13:
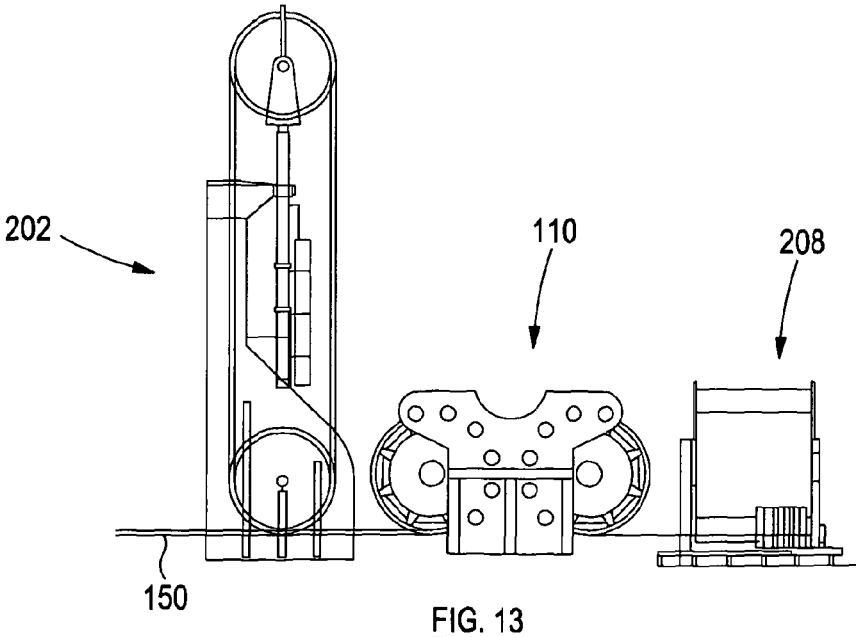
FIG. 13 is a representation of a winch system which incorporates the winch apparatus of FIG. 12.

The arrangement in FIG. 13 also reflects an offshore application and in this example includes the winch apparatus 110 first shown in FIG. 9. The arrangement shown may include the same components as those of FIG. 13, such as the heave compensator 202. However, in the present arrangement the inboard end of the spoolable medium 150 is spooled to and from a winch drum 208, which may provide storage for the spoolable medium 150, and also establish a required degree of tension within the inboard end of the spoolable medium.

It should be understood that the embodiments described herein are merely exemplary and that various modifications may be made thereto without departing from the scope of the present invention.

The invention claimed is:

1. A winch apparatus comprising first and second drum assemblies each defining a circumferentially discontinuous drum contact surface for engaging a common spoolable medium, each drum assembly having a plurality of support elements which interleave each other and collectively define the respective drum surfaces, wherein the first and second drum assemblies are arranged to rotate about respective first and second axes of rotation which are inclined relative to each other.

2. The winch apparatus according to claim 1, wherein said winch apparatus is configured as a capstan winch apparatus.

3. The winch apparatus according to claim 1, wherein the first and second axes of rotation are inclined relative to each other in two reference planes.

4. The winch apparatus according to claim 3, wherein the two reference planes are mutually perpendicular.

5. The winch apparatus according to claim 1, wherein the first and second axes of rotation are inclined at least one of axially and radially relative to each other.

6. The winch apparatus according to claim 1, wherein each drum contact surface is aligned generally parallel to an associated drum axis of rotation such that the drum contact surfaces of the respective first and second drum assemblies are also inclined relative to each other to the same extent as the first and second axes of rotation.

7. The winch apparatus according to claim 1, wherein the first and second drum assemblies are configured to engage a wrapped intermediate portion of the common spoolable medium, such that end portions of the common spoolable medium on either side of the intermediate wrapped portion extend outwardly from the winch apparatus to define an outboard end portion and an inboard end portion.

8. The winch apparatus according to claim 7, comprising a tensioner arrangement for applying a degree of tension to at least one end portion of the common spoolable medium.

9. The winch apparatus according to claim 1, wherein the relative inclined alignment of the first and second axes of rotation of the drum assemblies is arranged to permit the respective drum contact surfaces to cooperate to manipulate an associated spoolable medium to follow a predefined path.

10. The winch apparatus according to claim 9, wherein the predefined path is helical.

11. The winch apparatus according to claim 1, wherein the angle of relative inclination of the first and second axes of rotation is fixed.

12. The winch apparatus according to claim 1, wherein the angle of relative inclination is adjustable.

13. The winch apparatus according to claim 1, wherein the angle of relative inclination of the first and second axes of rotation is selected to be in the region of 1 to 3 degrees.

14. The winch apparatus according to claim 1, wherein for each single wrap of the common spoolable medium, one portion of the common spoolable medium wrap engages the drum contact surface of the first drum assembly, and the remaining portion engages the drum contact surface of the second drum assembly.

15. The winch apparatus according to claim 1, wherein the drum assemblies overlap in an axial direction.

16. The winch apparatus according to claim 1, wherein the drum assemblies overlap in a radial direction.

17. The winch apparatus according to claim 1, wherein the drum assemblies intermesh each other.

18. The winch apparatus according to claim 1, wherein the support elements are elongate.

19. The winch apparatus according to claim 1, wherein the support elements are circumferentially arranged about a respective axis of rotation of the drum assemblies.

20. The winch apparatus according to claim 1, wherein each support element comprises an individual support surface arranged to define a discrete portion of a respective drum contact surface.

21. The winch apparatus according to claim 20, wherein the individual support surface of one or more support elements defines an arc shape.

22. The winch apparatus according to claim 1, wherein each support element defines an arc shape support surface, wherein the combined arc angle of the support elements of a single drum assembly extends approximately 360 degrees.

23. The winch apparatus according to claim 1, wherein a pair of adjacent support elements define respective arc shaped surfaces, wherein facing edges of the adjacent arc shaped surfaces are arranged tangentially to each other.

24. The winch apparatus according to claim 1, wherein the support elements are rigidly mounted within the respective drum assemblies.

25. The winch apparatus according to claim 1, wherein the support elements are adjustably mounted within a respective drum assembly.

26. The winch apparatus according to claim 1, wherein the support elements are arranged relative to each other to create the discontinuous drum contact surface, with adjacent support elements spaced from each other to define a gap therebetween.

27. The winch apparatus according to claim 26, wherein the support elements of one drum assembly are positioned in the gaps between the support elements on the other drum assembly.

28. The winch apparatus according to claim 1, wherein the drum assemblies are arranged on separate support shafts.

29. The winch apparatus according to claim 1, wherein the drum assemblies are arranged on a common support shaft.

30. The winch apparatus according to claim 29, wherein one or both of the drum assemblies are offset relative to the support shaft to provide the relative inclination between the first and second axes of rotation.

31. The winch apparatus according to claim 1, wherein the drum assemblies are arranged to be offset from each other in a radial direction to be positioned side by side.

32. The winch apparatus according to claim 1, comprising a drive arrangement configured to drivingly rotate both drum assemblies.

33. The winch apparatus according to claim 32, wherein the drive arrangement is configured to synchronously drive both drum assemblies.

34. The winch apparatus according to claim 32, wherein the drive arrangement comprises a single drive assembly configured to drive both drum assemblies.

35. The winch apparatus according to claim 32, wherein the drive arrangement comprises a first drive apparatus associated with the first drum assembly, and a second drive apparatus associated with the second drum assembly.

36. The winch apparatus according to claim 32, wherein the drive arrangement functions to provide braking to one or both drum assemblies.

37. The winch apparatus according to claim 1, wherein the surface of one or both of the drum contact surfaces is configured such that the coefficient of friction between the respective surfaces and the common spoolable medium is less than the coefficient of friction between individual components of the common spoolable medium.

38. A method for establishing a tension gradient within a common spoolable medium, comprising:

providing first and second drum assemblies each having a plurality of support elements which interleave each other and define a circumferentially discontinuous drum contact surface;

wrapping a portion of the common spoolable medium around the contact surface of both the first and second drum assemblies;

rotating both the first and second drum assemblies about respective first and second axes of rotation which are inclined relative to each other wherein said common spoolable medium is in intermittent contact with each discontinuous drum contact surface.

39. A winch system comprising a winch apparatus including first and second drum assemblies each having a plurality of support elements which interleave each other and define a circumferentially discontinuous drum contact surface for engaging a common spoolable medium, wherein the first and second drum assemblies are arranged to rotate about respective first and second axes of rotation which are inclined relative to each other.

40. A winch apparatus comprising first and second drum assemblies each including a plurality of support elements forming a circumferentially discontinuous drum contact surface for engaging a common spoolable medium, wherein the support elements of each drum assembly interleave each other.

41. The winch apparatus according to claim 40, wherein the drum assemblies are arranged to rotate about respective first and second axes of rotation which are inclined relative to each other.

* * * * *